US005791124A

United States Patent [19]

Spatafora

[11] Patent Number: 5,791,124

[45] Date of Patent: Aug. 11, 1998

[54] METHOD AND MACHINE FOR WRAPPING GROUPS OF PRODUCTS

[75] Inventor: Mario Spatafora, Bologna, Italy

[73] Assignee: Azionaria Costruzioni Macchine Automatiche A.C.M.A.S.p.a., Bologna, Italy

[21] Appl. No.: 555,328

[22] Filed: Nov. 8, 1995

[30] Foreign Application Priority Data

Nov. 11, 1994 [IT] Italy ..... BO94 A 000496

[51] Int. Cl.[6] ..... B65B 43/10

[52] U.S. Cl. ..... 53/456; 53/444; 53/458

[58] Field of Search ..... 53/456, 397, 447, 53/444, 148, 540, 580, 574, 578, 579, 376.4, 377.2, 377.5, 207, 208, 462, 458, 563, 149, 150, 575

[56] References Cited

U.S. PATENT DOCUMENTS

| | | | |
|---|---|---|---|
| 3,530,640 | 9/1970 | Hoffmann | 53/574 |
| 3,555,776 | 1/1971 | Nigrelli | 53/196 |
| 3,739,545 | 6/1973 | Lattke | 53/578 |
| 3,986,319 | 10/1976 | Puskarz et al. | 53/456 |
| 5,148,654 | 9/1992 | Kisters | 53/462 |

FOREIGN PATENT DOCUMENTS

| | | |
|---|---|---|
| 0163091 | 12/1985 | European Pat. Off. . |
| 0400817 | 12/1990 | European Pat. Off. . |
| 0588298 | 3/1994 | European Pat. Off. . |
| 1511520 | 4/1968 | France . |
| 2416579 | 10/1975 | Germany . |
| 903131 | 8/1962 | United Kingdom . |
| 2120629 | 12/1983 | United Kingdom . |

*Primary Examiner*—Linda Johnson
*Assistant Examiner*—John Paradiso
*Attorney, Agent, or Firm*—Ladas & Parry

[57] ABSTRACT

A method and machine for wrapping groups of products, whereby, by means of a U-shaped shuttle with its concavity facing upwards, groups of products are fed successively to the loading station of a wrapping conveyor coplanar with the shuttle and traveling in a direction crosswise to the traveling direction of the shuttle; and a U-shaped folding spindle with its concavity facing the shuttle is brought into contact with the central panel of a blank fed into the loading station by the wrapping conveyor, and receives a group from the shuttle prior to the blank being folded about the spindle to form a tray, and prior to the spindle being withdrawn from the tray.

7 Claims, 4 Drawing Sheets

6
25
44
45
72
47
55
9
41
24
26
44
72
51a
51
50
49
56
57
42
58
48
54
56
48
58
49
42
50
40
57
51a
51

74
71
72
44
72
44
6
49
49
55
67
41
70
68
69
62
70
42
62
73
61
60
66
65
59
63
64
40

METHOD AND MACHINE FOR WRAPPING GROUPS OF PRODUCTS

BACKGROUND OF THE INVENTION

The present invention relates to a method of wrapping groups of products.

In particular, the present invention relates to a method of wrapping groups of products, each comprising a number of products in a number of layers, and each layer comprising a number of side by side products.

Known wrapping machines for groups of products of the above type normally provide for forming an open-topped tray about each group, and normally comprise a group forming station; at least one conveyor element for stabilizing the shape of each group and feeding it on to a respective blank lying in a plane and on a fixed tubular die extending downwards from the plane; and push means for engaging and pushing the group, together with the blank, through the tubular die, which folds the blank about the group to form a tray, which is then fed on to an output conveyor beneath the plane.

The wrapping method adopted on known machines of the above type presents several drawbacks, due to the blanks being folded about the respective groups of products by directly subjecting the products to a force parallel to the longitudinal axis of the tubular die, thus resulting in possible damage to the products. Also, the trays are formed as the groups move substantially vertically between the forming plane and the surface of the output conveyor, thus seriously complicating the structure of the wrapping machine.

SUMMARY OF THE INVENTION

It is an object of the present invention to provide a wrapping method designed to overcome the aforementioned drawbacks.

According to the present invention, there is provided a method of wrapping groups of products; characterized in that it comprises the stages of loading a flat blank into a wrapping pocket so as to fold two lateral panels of the blank about a central panel and so impart to the blank a substantially U shape with its concavity facing in a first direction crosswise to the central panel; feeding a group of products on to the central panel and into the pocket in a feed direction perpendicular to said first direction and parallel to the folded lateral panels; and folding further portions of the blank crosswise to said feed direction to form a tray enclosing the group and located inside said pocket; the tray presenting a bottom wall defined by the central panel.

The above method preferably also comprises the further stage of moving a folding spindle into the pocket, between the folded lateral panels, and into contact with the central panel; the spindle being U-shaped, and being positioned inside the pocket with its concavity facing in a second direction the same as but opposite said feed direction.

Also, according to the above method, feeding the group on to the central panel preferably comprises the substages of feeding the group on to a shuttle; moving the shuttle in said feed direction into an unloading position wherein the output end of the shuttle engages said pocket; and unloading the group from the shuttle on to the central panel by moving the group in relation to the shuttle in said feed direction and through said output end.

The present invention also relates to a machine for wrapping groups of products.

According to the present invention, there is provided a machine for wrapping groups of products, characterized in that it comprises a wrapping pocket; first folding means, in turn comprising two plates defining two lateral walls of the pocket and imparting to the pocket a U shape with its concavity facing in a first direction, the pocket cooperating with a blank in such a manner as to receive a central panel of the blank between the two lateral walls, and fold two lateral panels of the blank about the central panel and in contact with said lateral walls to impart to the blank a substantially U shape with its concavity facing crosswise to the central panel and in said first direction; a feed unit for feeding a group of products into the pocket in a feed direction perpendicular to said first direction and parallel to said lateral walls; and further folding means for folding further portions of the blank crosswise to said feed direction to form a tray, the bottom wall of which is defined by said central panel.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
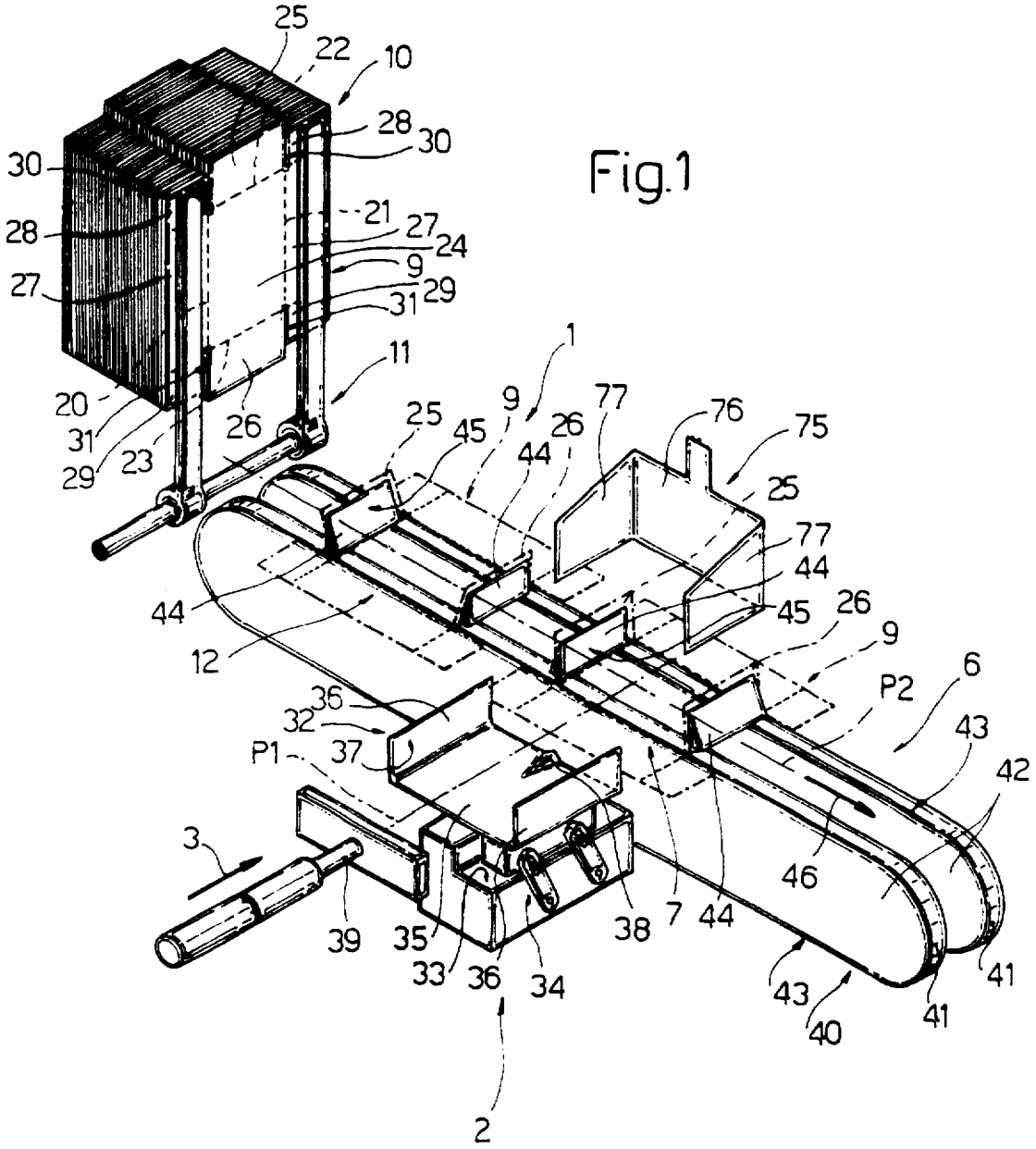
FIG. 1 shows a schematic view in perspective, with parts removed for clarity, of a preferred embodiment of the wrapping unit according to the present invention.

With reference to FIGS. 1 and 2, number 1 indicates a wrapping or tray forming machine comprising a feed unit 2 for successively feeding, in a horizontal direction 3 and along a substantially straight path P1, groups 4 (FIG. 2*b*) of products 5 (FIG. 2*b*), each group 4 comprising a number of superimposed layers, and each layer comprising a number of side by side products 5. Machine 1 also comprises a wrapping unit 6 for successively receiving groups 4 from feed unit 2 at a loading station 7, and forming a tray 8 (FIG. 2*e*) about each group 5 from a flat blank 9 fed by wrapping unit 6 along a path P2 crosswise to path P1 and intersecting path P1 at station 7.

Machine 1 also comprises a blank store 10 located upstream from wrapping unit 6 along path P2; and a known extracting device 11 for successively withdrawing blanks 9 from store 10 and feeding them to wrapping unit 6 at an input station 12 located upstream from station 7 along path P2.

Figure 2A:
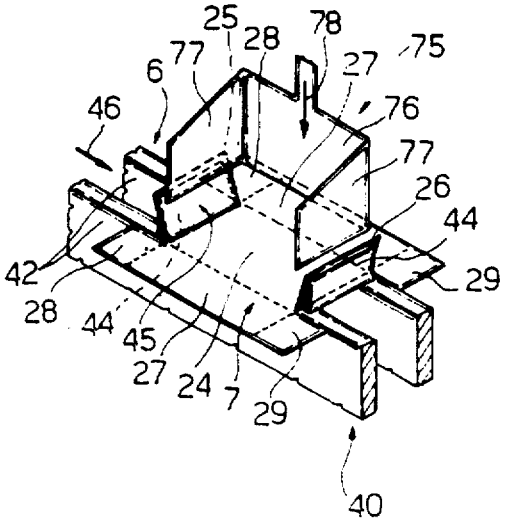
FIGS. 2*a* to 2*e* show a view in perspective, with parts removed for clarity, of the FIG. 1 unit in different operating positions.
Figure 2D:
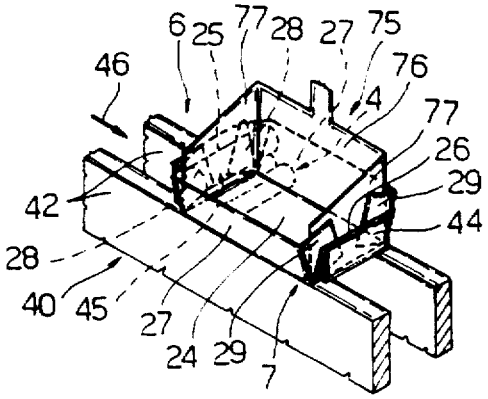
Figure 2B:
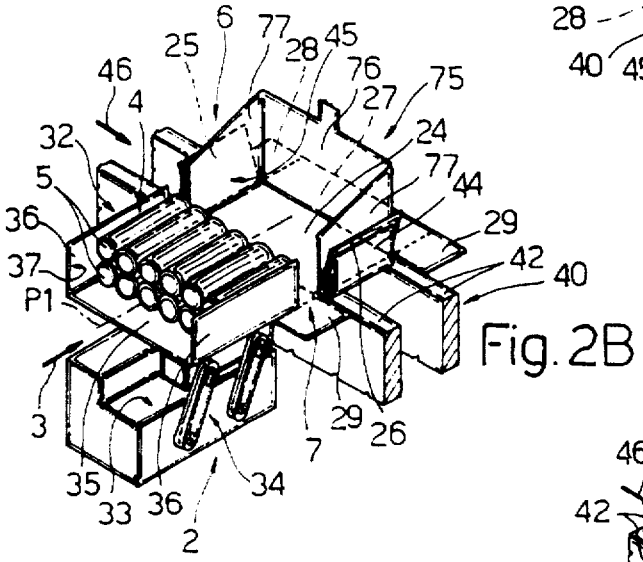
Figure 2E:
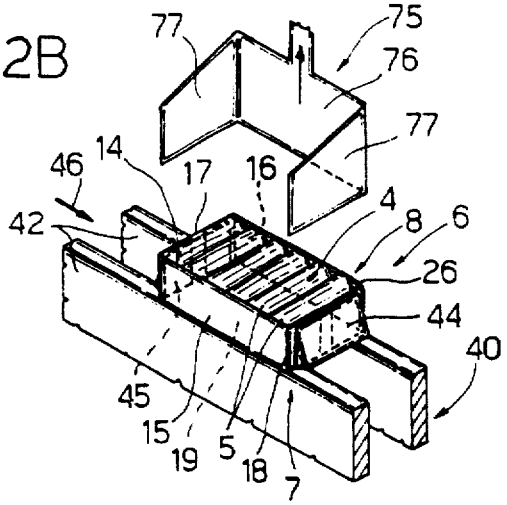
Figure 2C:
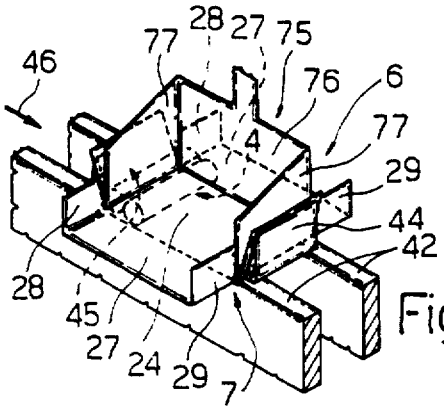

As shown in FIG. 2*e*, tray 8 is cup-shaped with its concavity facing upwards, presents an open top end 14, and comprises two first lateral walls 15 and 16 facing and parallel to each other, two second lateral walls 17 and 18 parallel to each other and perpendicular to walls 15 and 16, and a bottom wall 19 perpendicular to walls 15, 16, 17 and 18. According to an embodiment not shown, tray 8 also presents a top lid (not shown) hinged to the free edge of wall 17 or 18 and rotating between two positions to respectively open and close end 14.

As shown in FIG. 1, tray 8 is formed from a substantially elongated rectangular blank 9 presenting two preformed longitudinal bend lines 20 and 21, and two preformed transverse bend lines 22 and 23. Lines 22 and 23 define, together with lines 20 and 21, a central panel 24 corresponding to bottom wall 19 of tray 8, and two lateral panels 25 and 26 extending on either side of panel 24 and respectively corresponding to walls 17 and 18 of tray 8.

Lines 20 and 21 each define, outwards of panels 24, 25 and 26, respective tabs 27, 28 and 29; and tabs 28, located outwards of panel 25, are integral with respective tabs 27 and separated from panel 25 by respective cuts 30 extending along lines 20 and 21. Similarly, tabs 29, located outwards of panel 26, are integral with respective tabs 27 and separated from panel 26 by respective cuts 31 extending along lines 20 and 21. Tabs 27 are folded squarely in relation to panel 24 to define walls 15 and 16 of tray 8; and tabs 28 and 29 are folded squarely in relation to respective tabs 27, and are rotated together with tabs 27 on to the inner surface of respective panels 25 and 26 to define, with panels 25 and 26, the lateral walls 17 and 18 of tray 8.

As shown in FIG. 1, feed unit 2 comprises a shuttle 32 which, by means of an articulated parallelogram type actuating device 34, is moved back and forth, along a guide 33 defining path P1, between a group 5 forming station (not shown) and loading station 7 (FIG. 2*b*).

Shuttle 32 presents a substantially U-shaped section with its concavity facing upwards, and comprises a flat bottom wall 35 from which extend upwards two lateral walls 36 defining, with wall 35, a channel 37 parallel to direction 3. Walls 36 converge slightly so that shuttle 32 is funnel-shaped and tapers towards loading station 7; and, at the output end, wall 35 presents a central wedge-shaped axial rib 38 projecting upwards and inwards of channel 37.

Feed unit 2 also comprises a pusher 39 which is moved back and forth along path P1 slightly faster than and substantially in time with shuttle 32, to load a group 4 into shuttle 32 in direction 3 and through a first end of shuttle 32, move the group 4 along channel 37, and unload the group 4 through the opposite end of shuttle 32 in the time taken by shuttle 32 to be moved along path P1 by actuating device 34.

Wrapping unit 6 comprises a conveyor 40, in turn comprising two chains 41 (FIG. 3), each of which is fitted to a respective plate 42 positioned on edge parallel to the other plate 42, and substantially in the form of an elongated rectangle with rounded ends. Each plate 42 presents an annular outer edge 43 acting as a slideway for respective chain 41, which is rotated clockwise (in FIG. 1) about respective plate 42 by a drive device (not shown).

Figure 3:
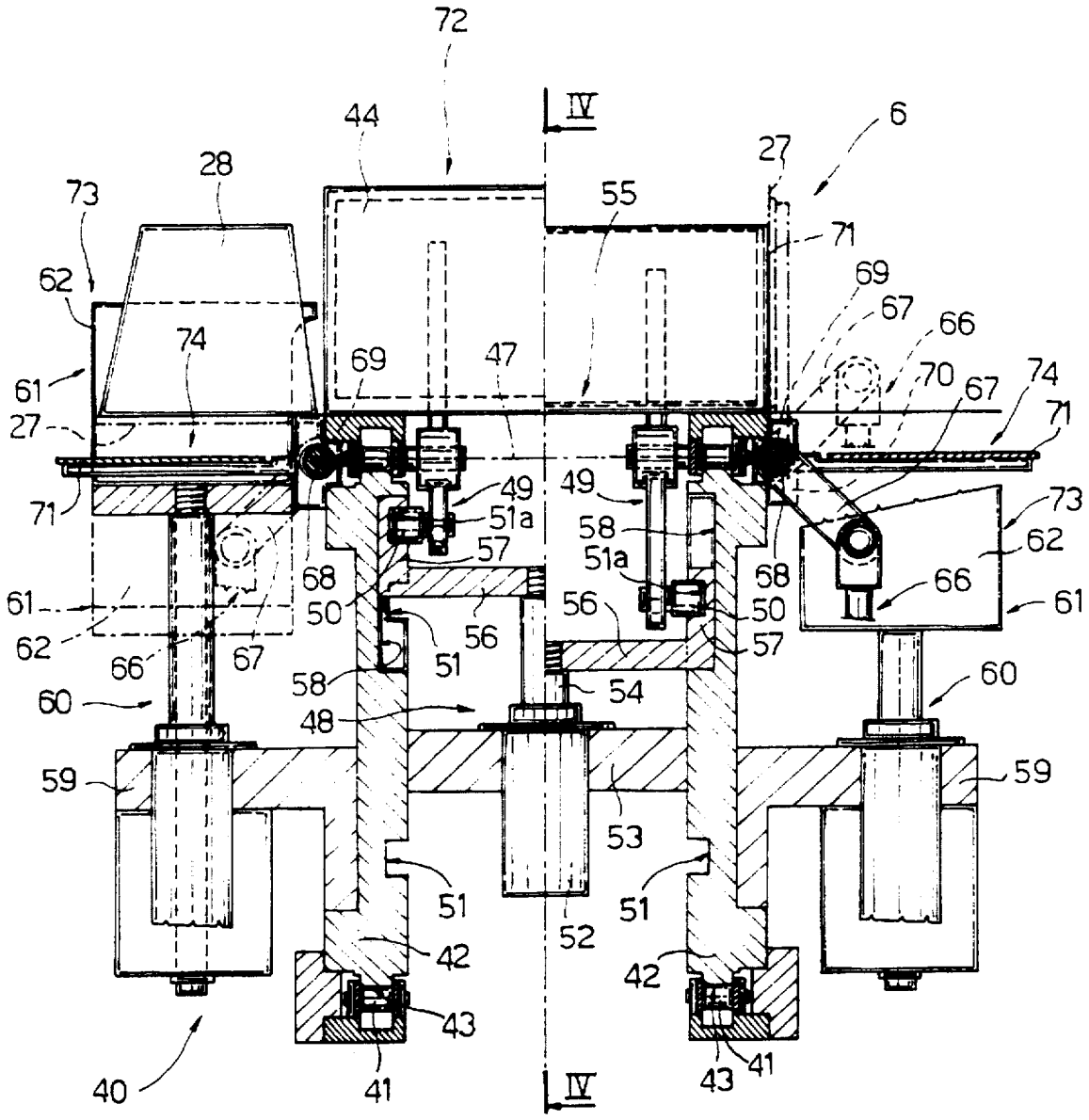
FIG. 3 shows a larger-scale cross section, with parts removed for clarity, of a FIG. 1 detail in two different operating positions.

With reference to FIG. 3, chains 41 are made integral with each other by a number of plates 44, each pair of which defines a pocket 45 for receiving a respective blank 9. More specifically, pockets 45 are equally spaced about the periphery of plates 42, and are each the same length as central panel 24 of blank 9 measured parallel to lines 20 and 21; and respective plates 44 are positioned crosswise to the traveling direction 46 of chains 41, and are each hinged to both chains 41 so as to oscillate, in relation to chains 41, about a respective axis 47 and by virtue of an actuating device 48 located at loading station 7 and common to all the pairs of plates 44.

Figure 4:
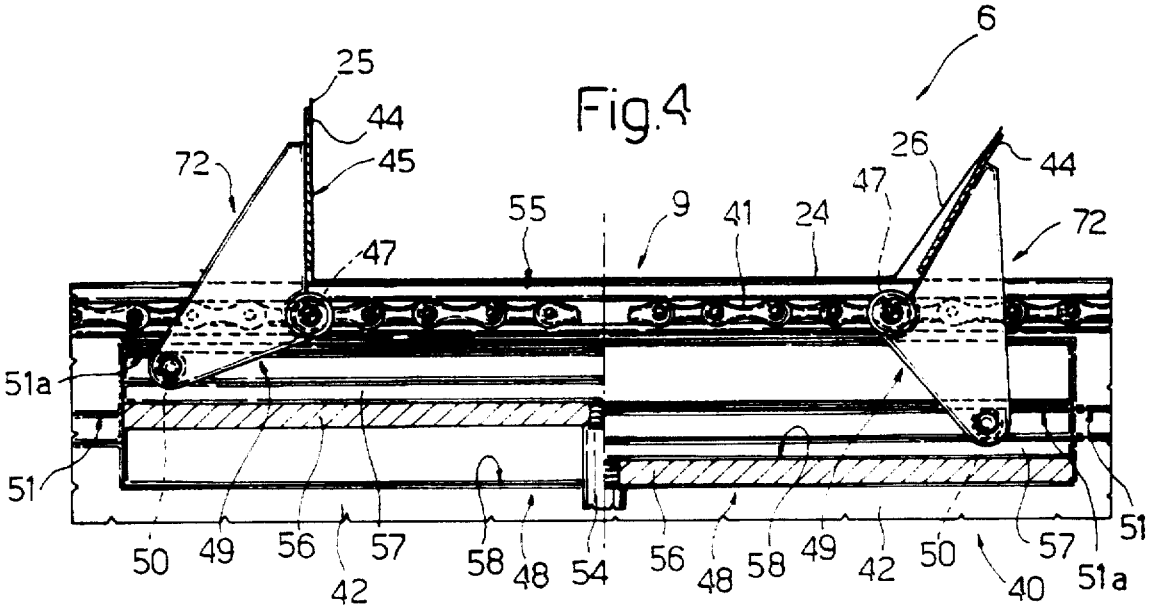
FIG. 4 shows a section along line IV—IV in FIG. 3.

As shown in FIGS. 3 and 4, each plate 44 is substantially rectangular, and is fitted, on the surface outside pocket 45, with a first arm of two rocker arms 49, each of which pivots about axis 47 common to both, and comprises a second arm extending between plates 42 and fitted with a respective tappet roller 50 engaging a respective annular groove 51 formed on the inner surface of the adjacent plate 42.

Actuating device 48 comprises a jack 52 fitted to a transverse wall 53 between plates 42, and presenting an output rod 54 facing upwards towards the transportation branch 55 of conveyor 40, which, together with pockets 45, is substantially coplanar with shuttle 32. Actuating device 48 also comprises a crosspiece 56 parallel to branch 55 and perpendicular to plates 42; and two ribs 57 parallel to plates 42, connected integral with the opposite ends of crosspiece 56, and extending upwards from crosspiece 56. Each rib 57 is housed in transversely slack manner inside a seat 58 formed longitudinally on the inner surface of respective plate 42 at loading station 7, and presents a groove 51*a* defining the portion of respective groove 51 extending through station 7. More specifically, both ribs 57 are movable transversely inside respective seats 58 by jack 52, and in a vertical direction, crosswise to branch 55 and to direction 46, between a lowered position wherein respective grooves 51*a* are aligned with the rest of respective grooves 51, and a raised position wherein respective grooves 51*a* are located over the rest of respective grooves 51.

Figure 5:
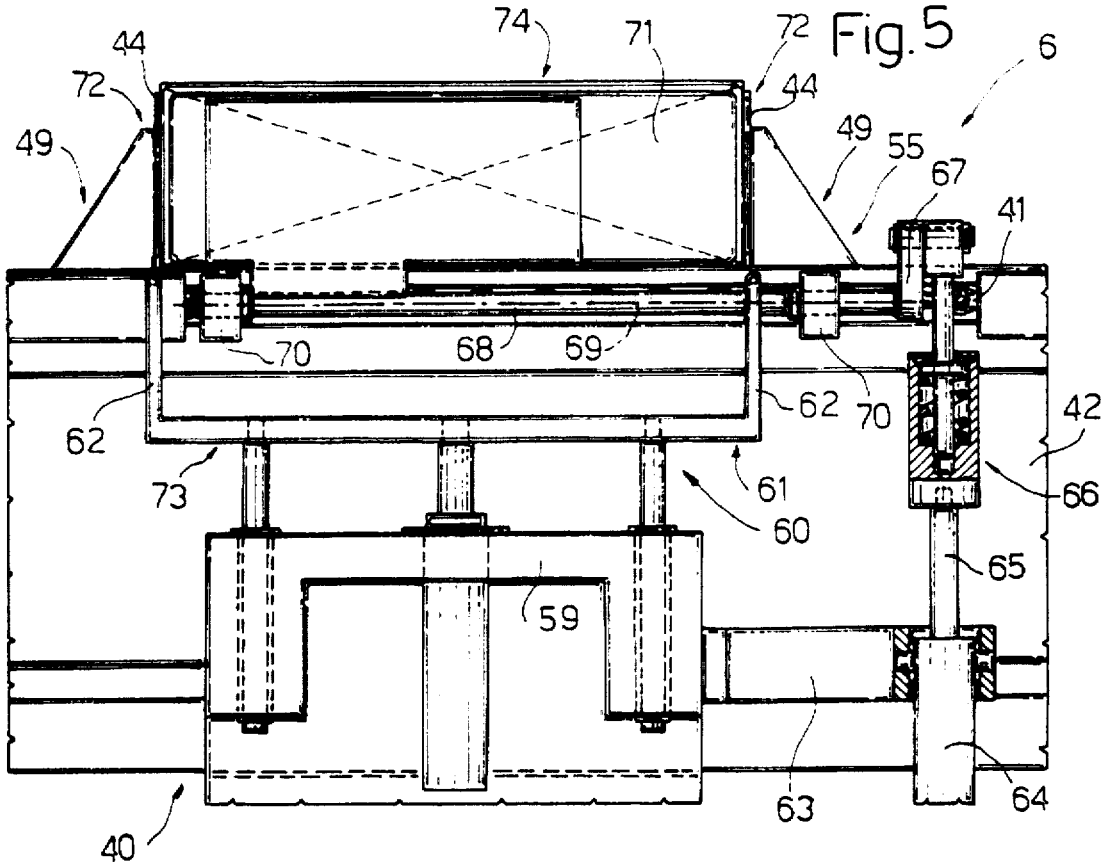
FIG. 5 shows a side view of the FIG. 3 detail.

As shown in FIGS. 3 and 5, at station 7, each plate 42 presents a horizontal outer bracket 59 fitted with an actuating device 60 for operating a folding fork 61 located parallel to direction 46 and of a width approximately equal to but no less than the length of panel 24 measured parallel to lines 20 and 21. Fork 61 presents two lateral arms 62, each extending vertically upwards outside respective plate 42, and each movable by actuating device 60 between a lowered position beneath branch 55, and a raised position above branch 55.

As shown in FIG. 5, each bracket 59 presents a lateral longitudinal appendix 63 on which pivots the body of a jack 64; and the output rod 65 of jack 64 is hinged, via the interposition of a damper 66, to the free end of a radial lever 67 of a shaft 68 parallel to direction 46 and mounted for rotation about its axis 69 between two end supports 70 fitted integral with respective plate 42. Each shaft 68 is connected integral with a lateral edge of a plate 71, which is movable, with shaft 68 about axis 69 and by jack 64, between a horizontal position substantially coplanar with transportation branch 55, and a vertical position substantially coplanar with respective plate 42.

The two plates 44, two forks 61 and two plates 71 define respective folding devices 72, 73 and 74 of wrapping unit 6, which also comprises a folding spindle 75 (FIG. 2) located over transportation branch 55 and movable, crosswise to direction 46 and by a known actuating device (not shown), to and from an operating position in which it engages a pocket 45 arrested in loading station 7. Spindle 75 is substantially U-shaped with its concavity facing shuttle 32, i.e. in the same but opposite direction to direction 3, and comprises a central core 76; and two lateral arms 77 crosswise to direction 46, separated by a distance approximately equal to but no more than the width of pocket 45 measured in direction 46, and no less than the distance between walls 36 of shuttle 32 at the output of channel 37, and of a length less than the distance between lines 20 and 21 of blank 9.

Operation of machine 1 will now be described relative to one pocket 45, and as of the instant in which conveyor 40 feeds and arrests the pocket 45 at input station 12.

When pocket 45 is arrested in station 12, tappet rollers 50 of folding device 72 engage respective grooves 51, so that plates 44 are maintained in the outwardly-inclined position shown on the right in FIG. 4; and extracting device 11 is activated to feed a blank 9 from store 10 into pocket 45. More specifically, device 11 lowers blank 9 on to pocket 45, so that central panel 24 is positioned between plates 44, which gradually contact and fold panels 25 and 26 to impart to blank 9 a substantially U shape with its concavity facing upwards, i.e. in a direction perpendicular to panel 24.

Conveyor 40 is then activated to move pocket 45 forward one step and arrest it in loading station 7, and to engage tappet rollers 50 in grooves 51*a* of ribs 57 which have so far been maintained by folding device 72 in the lowered position shown on the right in FIGS. 3 and 4, wherein grooves 51*a* are aligned with the portions of respective grooves 51 on either side of respective seats 58 to permit rollers 50 to pass from grooves 51 to respective grooves 51*a*. Upon pocket 45 being arrested in station 7, folding device 72 is preferably activated to move ribs 57 into the raised position shown on the left in FIGS. 3 and 4, and plates 44 into the fully raised position perpendicular to direction 46, so as to fully weaken blank 9 along the portion of lines 22 and 23 defining panel 24. In any case, ribs 57 are then restored to the lowered position to permit pocket 45 (FIG. 2*a*) to receive spindle 75, which is normally positioned over station 7, and is moved in a vertical direction 78 to position core 76 along line 21 and arms 77 along lines 22 and 23 of blank 9.

At the same time pocket 45 is fed into station 7, a respective group 4 of products 5 is formed at the input (not shown) of feed unit 2, and is loaded on to shuttle 32 by pusher 39 which, traveling in direction 3 with but faster than shuttle 32, feeds group 4 along channel 37 towards station 7. The movement of shuttle 32 in direction 3 terminates upon shuttle 32 reaching an unloading position in which a relatively small portion of the ends of walls 36 facing station 7 is engaged between arms 77 of spindle 75, whereas pusher 39 continues moving to unload group 4 on to panel 24, between arms 77, and against core 76 of spindle 75.

In connection with the above, it should be pointed out that, as group 4 is expelled from shuttle 32 by pusher 39, rib 38 pushes up the central products 5 of group 4, so that group 4 is inserted easily between arms 77 and, as explained more clearly later on, products 5 adhere perfectly to walls 17 and 18 of tray 8.

Upon pusher 39 and shuttle 32 withdrawing to clear station 7, folding device 73 is activated to move forks 61 from the lowered position (FIG. 5 and on the right in FIG. 3) to the raised position (on the left in FIG. 3) to fold tabs 28 and 29 (FIG. 2*d*) squarely in relation to respective tabs 27; and folding device 74 is then activated to position plates 71 perpendicular to axes 47 and so fold tabs 27 squarely and (FIG. 2*d*) insert tabs 28 and 29 inside the gap between respective arms 77 and plates 44.

At this point, spindle 75 is withdrawn, and folding device 72 is activated to position walls 44 perpendicular to axes 69 and so complete tray 8. Despite withdrawal of spindle 75, walls 17 and 18 of tray 8 adhere perfectly to products 5 of group 4, by virtue of group 4, previously curved upwards in the middle by rib 38, again settling into the flat position by occupying the gap formerly occupied by arms 77.

I claim:

1. A method of wrapping groups (4) of products (5), the method comprising the steps of:

feeding a flat blank (9) to a wrapping pocket (45), the blank comprising a central panel (24), two lateral panels (25, 26) extending from opposite sides of the central panel (24), and further panels (27, 28, 29) arranged about the central panel (24) and connected thereto;

folding said two lateral panels (25, 26) about the central panel (24) so as to impart to the blank (9) a substantially U shape with its concavity facing in a first direction crosswise to the central panel (24), said folding being carried out by loading said blank (9) into the wrapping pocket (45);

moving a folding spindle (75) into the pocket (45), between the folded lateral panels (25, 26), and into contact with the central panel (24), the spindle (75) being U-shaped, and being positioned inside the pocket (45) with its concavity facing in a second direction perpendicular to said first direction and parallel to the folded lateral panels (25, 26);

feeding a group (4) of products (5) onto the central panel (24) and into the folding spindle and the pocket (45) in a feed direction (3) parallel to but opposite said second direction; and folding at least some of said further panels (27, 28, 29) of the blank (9) crosswise to said feed direction (3) and about the group (4) and the folding spindle (75) to form a tray (8) enclosing the group (4) and located inside said pocket (45), the tray (8) having a bottom wall (19) defined by the central panel (24).

2. The method claimed in claim 1, comprising the further step of withdrawing the spindle (75) from the tray (8) perpendicularly to the central panel (24).

3. The method claimed in claim 1, wherein feeding the group (4) onto the central panel (24) comprises the substeps of feeding the group (4) onto a shuttle (32); moving the shuttle (32) in said feed direction (3) into an unloading position wherein the output end of the shuttle (32) engages said pocket (45) and said spindle; and unloading the group (4) from the shuttle (32) onto the central panel (24) by moving the group (4) in relation to the shuttle (32) in said feed direction (3) and through said output end.

4. The method claimed in claim 3, wherein the group, as it is unloaded off the shuttle (32), is bent in a direction parallel to but opposite said first direction, and about a central region extending parallel to said two lateral panels (25, 26), to reduce its width.

5. The method claimed in claim 1, wherein said pocket (45) is defined by two walls (44) movable to and from an operating position in which they are parallel to each other and substantially cooperate with said spindle; said two walls (44) being moved from said operating position to define a gap between each of the two walls (44) and said spindle (75), and to allow the insertion of at least part of said further panels (28, 29) of the blank (9) inside said gaps.

6. The method claimed in claim 3, wherein the shuttle (32) and the pocket (45) are substantially coplanar; the group (4) being moved solely in said feed direction (3) as it is fed from the shuttle (32) onto the central panel (24).

7. The method claimed in claim 1, wherein the pocket (45) forms part of a pocket conveyor (40), and is moved in steps in a third direction (46) crosswise to said first direction and said feed direction (3) through an input station (12) where a blank (9) is loaded into the pocket (45) so as to fold said lateral panels (25, 26), and through a loading station (7) where the group (4) is loaded onto the central panel (24).

* * * * *